US005371930A

United States Patent [19]

Lindenmueller et al.

[11] Patent Number: 5,371,930

[45] Date of Patent: Dec. 13, 1994

[54] APPARATUS FOR TRANSFERRING A WARP THREAD EXCHANGE SYSTEM INTO A LOOM

[75] Inventors: Walter Lindenmueller, Lindau, Germany; Robert Tillmann, Buers, Austria; Karl Wagner, Bad Saeckingen, Germany

[73] Assignee: Lindauer Dornier GmbH, Lindau, Germany

[21] Appl. No.: 136,385

[22] Filed: Oct. 13, 1993

[30] Foreign Application Priority Data

Oct. 14, 1992 [DE] Germany ..... 4234563

[51] Int. Cl.[5] ..... B65H 1/00

[52] U.S. Cl. ..... 28/208; 28/201

[58] Field of Search ..... 28/196, 197, 203, 201, 28/208, 200, 172.1; 242/68.4, 58.6, 129.5; 414/258, 233, 234, 235, 236; 139/1 R, 109, 353

[56] References Cited

U.S. PATENT DOCUMENTS

| | | | |
|---|---|---|---|
| 1,304,875 | 5/1919 | Hathaway | 28/201 |
| 2,706,056 | 4/1955 | Talley et al. | 28/201 |
| 2,994,939 | 8/1961 | Matthews | 28/201 |
| 3,280,442 | 10/1966 | Meierhofer | 28/203 |
| 3,675,686 | 7/1972 | Steiner et al. | 28/203 |
| 4,878,279 | 11/1989 | Tachibana et al. | 28/203 |
| 4,910,837 | 3/1990 | Fujimoto et al. | 28/201 |
| 4,934,413 | 6/1990 | Yao . | |
| 5,197,521 | 3/1993 | Graser et al. . | |

FOREIGN PATENT DOCUMENTS 4109408 9/1992 Germany .

*Primary Examiner*—Clifford D. Crowder
*Assistant Examiner*—Larry D. Worrell, Jr.
*Attorney, Agent, or Firm*—W. G. Fasse; W. F. Fasse

[57] ABSTRACT

A cart for transferring a warp exchange system from a machine that prepares such a warp exchange system to a warp beam lifting carriage, is equipped to at least temporarily store a prepared warp exchange system after having picked up the system from a warp drawing-in carriage that forms part of the machine for preparing the warp exchange system. The cart is further compatible to transfer the stored system to a warp beam lifting carriage which in turn inserts the system into a loom. The cart makes sure that the warp exchange system is presented with the proper orientation relative to the loom so that the insertion can take place in the manner of a cassette formed by the cart and the warp exchange system including the warp beam.

10 Claims, 4 Drawing Sheets

APPARATUS FOR TRANSFERRING A WARP THREAD EXCHANGE SYSTEM INTO A LOOM

FIELD OF THE INVENTION

The invention relates to an apparatus for transferring a warp thread exchange system that has been prepared in a warp thread drawing-in machine, to a warp beam lifting carriage that will insert the prepared warp thread exchange system into a loom.

BACKGROUND INFORMATION

An apparatus of the type described above must be capable of presenting a newly prepared warp thread exchange system to the loom with the proper orientation so that the exchange can be performed in a minimum of time. A cartridge type exchange would be ideal. The warp thread drawing-in machine which prepares a new warp thread exchange system includes a warp drawing-in carriage that must necessarily be adapted to the requirements of the warp thread drawing-in machine. Similarly, a warp beam lifting carriage that lifts a new warp beam into a loom is primarily adapted for cooperation with the loom. As a result, the warp drawing-in carriage is not necessarily adapted for direct cooperation with a loom nor with the warp beam lifting carriage that lifts the warp beam into the loom and vice versa. The direct cooperation between the warp thread drawing-in carriage and the warp beam lifting carriage poses problems in that these two carriages must be made compatible with each other which heretofore has resulted in expensive equipment that still does not permit an economic storing of prepared warp thread exchange systems between their preparation and their insertion into a loom. Providing a plurality of expensive warp beam lifting carriages for each loom for the purpose of temporarily storing a prepared warp exchange system is economically not feasible.

Incidentally, the warp thread exchange system, also referred to as the warp exchange system, comprises the following components: a warp beam, a warp stop motion unit, a transport unit for the warp stop motion unit, a heald frame, a reed, and warp thread guides. However, conventionally such systems once prepared cannot be stored economically.

U.S. Pat. No. 4,934,413 (Yao), issued Jun. 19, 1990, discloses a method and machine for inserting a warp thread exchange system into a loom. The method of the just mentioned U.S. Patent is performed as follows. First, a new warp exchange system is prepared by drawing-in warp threads into the heald frame of the warp thread exchange system which includes the above mentioned components. Next, the warp beam is inserted into the loom. During the insertion, the tension of the warp threads is sensed to provide a warp tension signal. This warp tension signal is used during the insertion to determine a deviation of the warp thread tension from a given standard warp tension value and the deviation is eliminated by rotating the warp beam so as to keep a difference between the sensed signal and the standard value substantially zero to maintain the proper tension on the warp threads.

The apparatus of U.S. Pat. No. 4,934,413 (Yao) includes a warp beam lifting carriage which also holds the above mentioned warp exchange system into which the warp threads coming from the warp beam have been drawn. The warp beam lifting carriage transfers the warp thread exchange system into the loom. The warp beam lifting carriage includes a device for taking up and lifting the warp beam and further devices, such as vertically and horizontally operable piston cylinder devices, for picking-up the warp exchange system from the drawing-in carriage outside the loom and for delivering the picked up exchange system into a predetermined position relative to the loom. The apparatus of U.S. Pat. No. 4,934,413 (Yao) further includes a sensor that contacts a warp thread guide roller for sensing or picking up the warp thread tension during the insertion of the warp exchange system into the loom. Further, a warp beam rotating device responsive to the above mentioned sensor is provided for rotating the warp beam in response to the signal received from the sensor to maintain a predetermined warp thread tension.

U.S. Pat. No. 4,934,413 (Yao) does not provide any suggestion with regard to the intermediate storage or holding of a prepared warp exchange system in such a way that the system may later be inserted into the loom with a proper orientation relative to the requirements of the loom. However, such proper orientation is necessary for a further reduction in the retooling time required for a warp beam and loom harness exchange. Such retooling in the shortest possible time is very important to the efficient operation of textile mills. Yao also does not provide any disclosure, nor any suggestion with regard to the preparation and storage of the warp exchange system as a cassette type system, whereby the cassette of the prepared warp exchange system is maintained in such a position that it has a proper orientation for the insertion into the loom so that insertion can be accomplished in the shortest possible time, while the storage of the prepared system is completely independent from the actual insertion into the loom.

U.S. Pat. No. 5,197,521 (Graser et al.), issued on Mar. 30, 1993 discloses a warp beam lifting carriage. German Patent Publication DE 4,109,408 (Hiemer), published on Sep. 24, 1992, discloses a weft thread monitoring unit constructed for easy transport.

OBJECTS OF THE INVENTION

In view of the above it is the aim of the invention to achieve the following objects singly or in combination:

- to minimize the retooling time of a loom equipped with an exchangeable warp exchange system;
- to provide a cassette type warp exchange system that is compatible with a warp thread drawing-in machine, with a go-between cart for temporary storage, and with the respective loom or rather with a warp beam lifting device;
- to make sure that the go-between cart receives the cassette type warp exchange system from a drawing-in carriage in a proper orientation and to present the warp exchange system to a warp beam lifting carriage also with the proper orientation for insertion into a loom;
- to permit preparing a warp exchange system that can be stored, at least temporarily, on a go-between cart able to cooperate with a warp drawing-in machine and with a warp beam lifting carriage, whereby the go-between cart must be substantially less expensive than a conventional warp beam lifting carriage; and
- to avoid or at least minimize the breaking of warp threads during an exchange of a warp exchange system.

SUMMARY OF THE INVENTION

According to the invention there is provided an apparatus for transferring a warp exchange system into a loom with a proper orientation of said warp exchange system relative to the loom. The apparatus includes a warp drawing-in first carriage for carrying the warp exchange system in a warp drawing-in machine which prepares the exchange system for a loom. The apparatus further includes a warp beam lifting second carriage for inserting the exchange system into a loom. A go-between cart is constructed for cooperation with the first and second carriages. The go-between cart includes a cart body which carries a support such as bearing bucks or a bearing trough for holding or supporting a warp beam. The go-between cart further includes a first carrier on the cart body for the warp exchange system. The first carrier includes at least one rigid post or rigid carrier member extending substantially vertically from the cart body, and positioned preferably next to the respective warp beam support buck or eccentrically relative to a warp beam longitudinal axis in the case of the bearing trough. The first carrier further includes a hinged carrier member and a journal securing one end of the hinged carrier member to the free end of the substantially vertically extending carrier member, whereby the hinged carrier member can be tilted between a substantially horizontal position for movement into the warp drawing-in carriage, and a substantially vertical position for taking over a prepared warp exchange system. The apparatus further includes a second carrier for holding at least part of the warp exchange system. The hinged carrier member of the first carrier has a free end including a holding device for holding the second carrier which includes a coupling device for enabling a take-over of the warp exchange system by the warp beam lifting second carriage. The go-between cart and the prepared warp exchange system on the cart form a cassette type structure that can be stored. The important feature of the invention is the go-between cart which cooperates with the warp drawing-in first carriage and the warp beam lifting second carriage to present the warp exchange system to the second carriage with the proper orientation of the warp exchange system relative to the loom into which the exchange system is to be inserted in the manner of a cassette. It is an important advantage that several go-between carts can be used, whereby each go-between cart is capable to at least temporarily hold a prepared warp exchange system ready for an immediate cartridge type insertion into a loom, whereby the time needed for retooling a loom is optimally reduced. Further, the present go-between cart makes sure that even a temporary storage of a prepared warp exchange system does not result in the undesirable tearing or breaking of the warp threads waiting in their exchange system for insertion into the loom. Breakage of warp threads is generally eliminated or at least reduced by the economical go-between cart.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
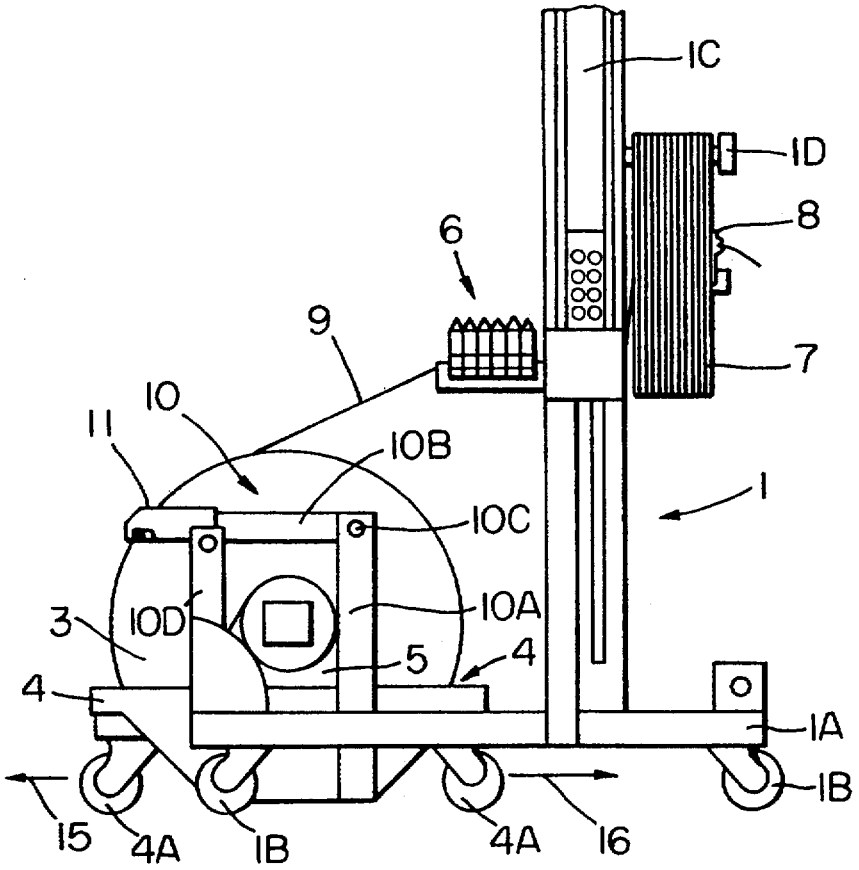
FIG. 1 shows a schematic side view of a warp thread drawing-in carriage that cooperates with a drawing-in machine not shown and into which a go-between cart according to the invention has moved.

In FIG. 1 the go-between cart 4 according to the invention is shown in its position moved into a warp thread drawing-in carriage 1 which is part of a warp drawing-in machine not shown. Such warp drawing-in machines are conventional and are used for preparing warp exchange systems that include the above mentioned elements, namely a warp beam 3, warp stop motion unit 6, heddle frames 7, and the reed 8. Normally, such a system also includes front and back warp thread guides 6B, 6C shown in FIG. 2.

The go-between cart 4 of the invention has a cart body 4' with swivel wheels 4A. The cart with its body 4' is moved into cooperation with the warp drawing-in carriage 1 in the direction of the arrow 15 and moved out of cooperation with the carriage 1 in the direction of the arrow 16. The carriage 1 also has a carriage platform 1A with swivel wheels 1B. An upright post 1C is rigidly secured to the carriage platform 1A to support the various components of the warp exchange system. An arm 1D securely holds the heald frame 7.

Figure 2:
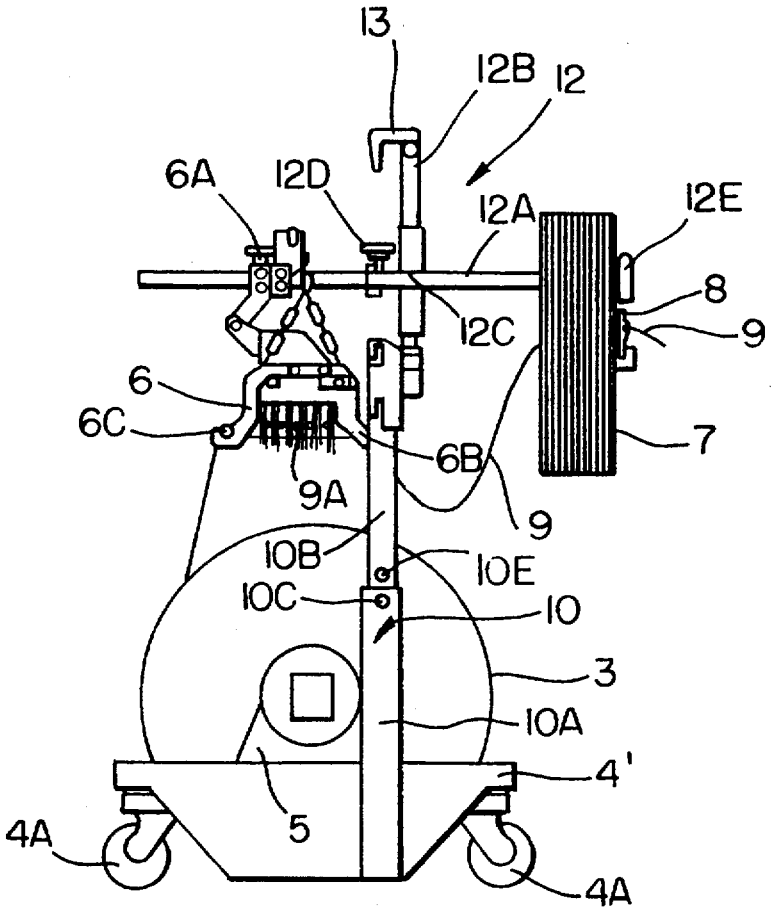
FIG. 2 shows the go-between cart after it has taken up the warp exchange system from the warp drawing-in carriage, whereby the go-between cart is now capable of at least temporarily storing or holding the warp exchange system.

The cart body 4' of the go-between cart carries a simple support 5 for warp beam 3. The support 5 may, for example, comprise two bearing bucks 5, one of which is rigidly secured to the cart body 4' at each end thereof. The support may also be in the form of a bearing or loading trough extending all the way crosswise of the cart body 4' for holding a warp beam 3 in the proper position. The cart body 4' rigidly supports a first carrier 10 which in turn supports a second carrier 12. The carriers 10 and 12 may be considered to be sections of a carrier device. The first carrier section 10 includes at least one, preferably two, rigid carrier members 10A extending substantially vertically from the cart body 4'. The rigid carrier member 10A forms an upright post that is positioned next to or close to the bearing bucks 5 or it is positioned eccentrically relative to the longitudinal rotational axis of the warp beam resting in a carrier or support trough. The first carrier section 10 further includes a hinged carrier member 10B that is journalled at 10C to the upper free end of the post 10A. The upper free end of the further carrier member 10B carries a holding device 11 to which the second carrier section 12 is removably securable. Due to the journal 10C, the carrier member 10B can be tilted into the horizontal position shown in FIG. 1, in which the carrier member 10B rests on the upper portion of a further upright post 10D. When the carrier member 10B is in the upright position as shown in FIG. 2, it is releasably locked at 10E, in its upright position. Due to the journal 10C, the carrier member 10B is tiltable back and forth between the substantially horizontal position shown in FIG. 1 and the substantially vertical position shown in FIG. 2.

This horizontal position of the carrier member 10B is required so that the cart 4 may travel in the direction of the arrow 15 into the carriage 1 to receive the warp beam 3.

After the cart 4 has received the warp beam 3, the cart 4 can travel out of the carriage 1 in the direction of the arrow 16, for example, by being manually pushed by an operator. As soon as the cart 4 is sufficiently moved out of the carriage 1, the carrier member 10B is tilted upwardly to raise the second carrier section 12 that is secured by the holding device 11 to the carrier member 10B. Thus, the carriers 10 and 12 pick up the warp exchange system, including the warp stop motion unit 6, the heald frame 7, and the reed 8. The holding device 11 releasably holds an end of the second carrier section 12 as will now be described in more detail with reference to FIG. 2.

FIG. 2 illustrates that the second carrier section 12 is removably held by the first carrier section 10 by the holding device 11. The second carrier section 12 comprises a horizontal support arm 12A, a vertical support arm 12B, and a cross-piece or clamp 12C that can be tightened or released by a screw 12D for connecting the horizontal and vertical support arms 12A and 12B to each other. The horizontal support arm 12A extends at a right angle to the first carrier 10 and in parallel to a horizontal plane of warp threads 9 in the warp stop motion unit 6. The horizontally extending warp threads are shown at 9A in FIG. 2 as these warp threads pass to the warp stop motion 6. The lower end of the vertical support arm 12B is engaged by the holding device 11. The upper end of the vertical support arm 12B carries a coupling device 13 for a form-locking, force-transmitting connection to a carrier arm 14A of a warp beam lifting carriage 14 to be described in more detail below with reference to FIG. 3.

Referring to FIG. 2, a clamp 6A releasably secures the warp stop motion unit 6 to the horizontal support arm 12A. The clamp 6A is adjustable in its position along the horizontal support arm 12A by loosening a conventional screw for properly positioning the warp stop motion unit 6. Warp thread guides 6B and 6C lead the warp threads through the stop motion unit 6. All components of the warp exchange system, namely the warp beam 3, the monitoring unit 6, the heald frame 7, the reed 8, and the thread guides 6B, 6C are held in such a position that the warp beam 3 and the carrier 12 can be taken over directly by the warp beam lifting carriage 14 shown in FIG. 3. The horizontal support arm 12A has a stop 12E that keep the heald frame 7 in the proper position. To release the connection between the lower end of the vertical carrier arm 12B and the holding device 11 a known clamp may be opened for the transfer.

Figure 3:
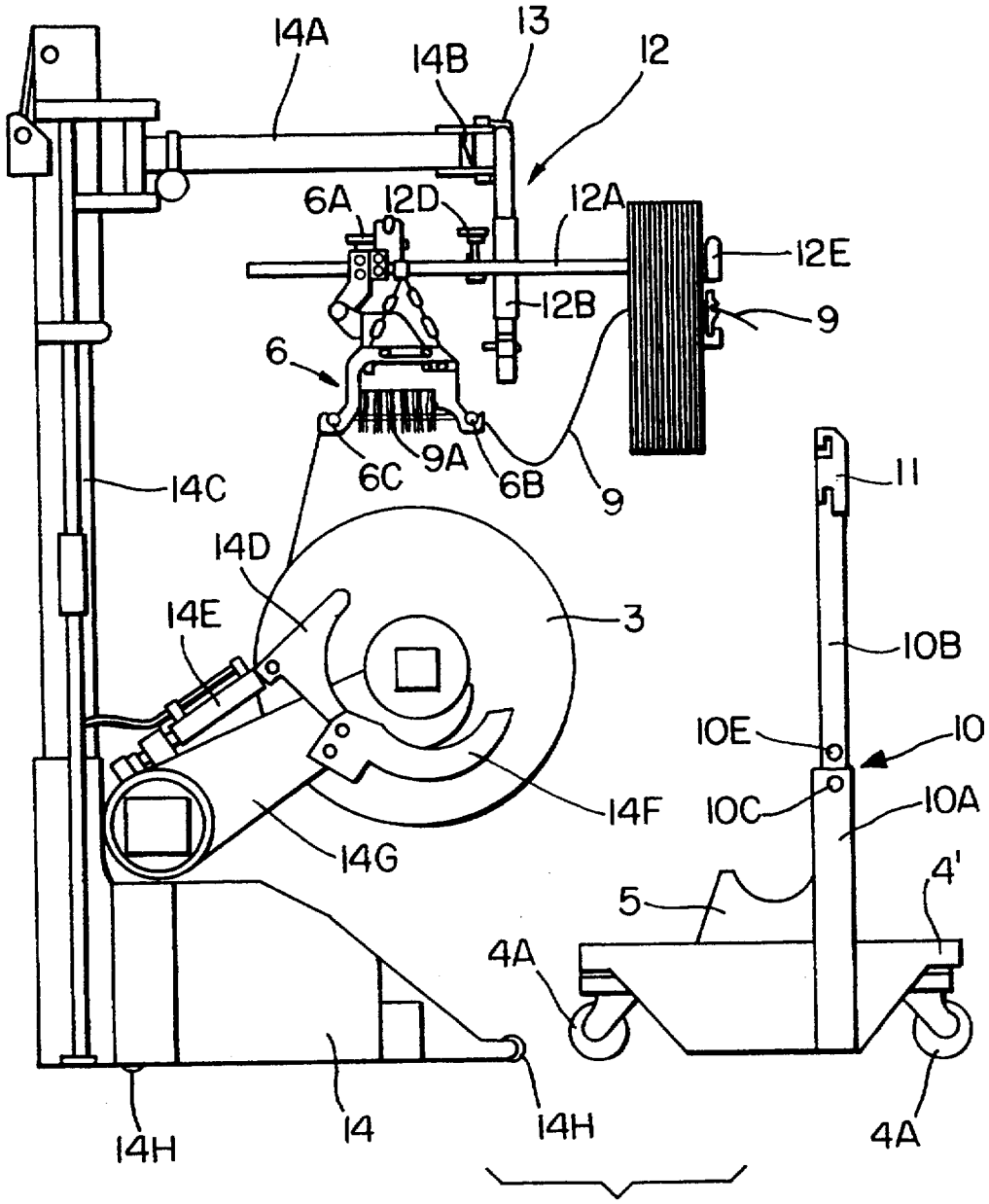
FIG. 3 shows the warp exchange system taken up by a warp beam lifting carriage from the go-between cart which is now ready to receive another prepared warp exchange system.

FIG. 3 illustrates the completed transfer of the warp exchange system from the cart 4 to the warp beam lifting carriage 14 equipped with a cantilever arm 14A carrying at its free end a coupling device 14B for a force-locking, yet releasable cooperation with the coupling device 13 at the upper end of the vertical carrier arm 12B. The cantilever arm 14A is secured to an upright post 14C which in turn is supported on the carriage 14 provided with wheels 14H. The carriage 14 further carries lifting devices for picking-up the warp beam 3. The lifting devices include a lifting arm 14G for holding the warp beam 3 and a clamping mechanism including a first claw 14D and a second claw 14F. The clamping mechanism is operated by a piston cylinder device 14E. U.S. Pat. No. 5,197,521 (Graser et al.), issued on Mar. 30, 1993, describes one such clamping or gripping mechanism in a warp beam lifting carriage. Such gripping mechanism is not part of the present invention. FIG. 3 further shows that the cart 4 is now again available for reloading without beam lifters.

Figure 4:
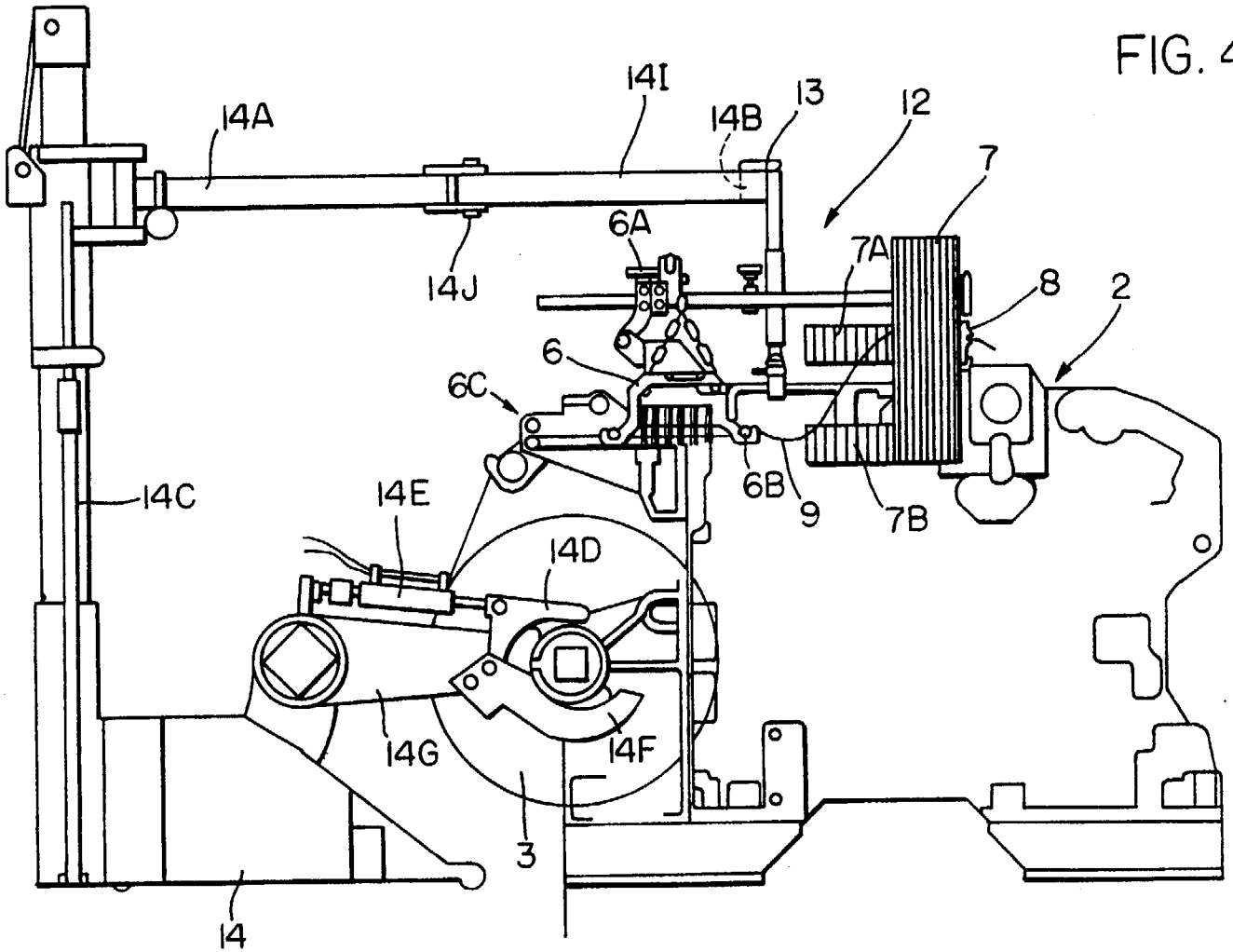
FIG. 4 shows the warp beam lifting carriage in the position for transferring the warp exchange system including the warp beam into a loom.

FIG. 4 shows the transfer operation for inserting the warp exchange system into a loom 2. Further details of a warp beam lifting carriage 14 are described, in the above mentioned U.S. Pat. No. 4,197,521 which is incorporated herein by reference. The cantilevered arm 14A may be equipped with an extension 14I that may either be secured by a hinge 14J to the arm 14A or it may be constructed as a telescoping extension for bringing the second carrier 12 into the correct insertion position relative to the loom 2.

Although the invention has been described with reference to specific example embodiments it will be appreciated that it is intended to cover all modifications and equivalents within the scope of the appended claims.

What we claim is:

1. An apparatus for transferring a warp exchange system including a warp beam into a loom with a proper orientation of said warp exchange system relative to said loom, comprising a warp drawing-in first carriage (1) for preparing said warp exchange system including said warp beam, a warp beam lifting second carriage (14) for inserting said warp exchange system (6, 7, 8) including said warp beam into said loom, a go-between cart (4) for cooperation with said first and second carriages (1, 14), said go-between cart (4) comprising a cart body, a fixed warp beam support (5) secured on said cart body for supporting said warp beam (3), a first carrier (10) on said cart body, said first carrier (10) including a rigid carrier member (10A) extending substantially vertically from said cart body, a hinged carrier member (10B), journal means (10C) securing said hinged carrier member (10B) to said substantially vertically extending carrier member (10A) so that said hinged carrier member (10B) is tiltable between a substantially horizontal position and a substantially vertical position, said apparatus further comprising a second carrier (12) for holding at least part of said warp exchange system (6, 7, 8), said hinged carrier member (10B) having a free end including a holding device (11) for holding said second carrier (12), said second carrier (12) comprising coupling means (13) for enabling a take-over of said warp exchange system by said warp beam lifting second carriage (14), so that said warp exchange system prepared on said drawing-in first carriage can be stored on said go-between cart.

2. The apparatus of claim 1, wherein said fixed warp beam support on said cart body comprises two warp beam support bucks (5), said first carrier (10) comprising two of said rigid substantially vertically extending carrier members (10A) for each respective one of said warp beam support bucks (5), each rigidly substantially vertically extending carrier member (10A) being positioned on said cart body next to the respective warp beam support buck (5).

3. The apparatus of claim 1, wherein said second carrier (12) comprises a horizontal support arm (12A), a vertical support arm (12B), and means (12C) operatively connecting said horizontal and vertical support arms (12A, 12B) to each other, said horizontal support arm (12A) extending at a right angle to said first carrier (10) and in parallel to a horizontal plane of warp threads (9) in said warp exchange system, said vertical support arm (12B) of said second carrier (12) having a lower end removably engageable by said holding device (11) of said hinged carrier member (10B), said vertical support arm (12B) having an upper end carrying said coupling means (13) for permitting said take-over, said warp beam lifting second carriage (14) comprising a carrier arm (14A) for engaging said coupling means (13) in a form-locking, force-transmitting manner.

4. The apparatus of claim 1, wherein said holding device (11) is releasable for temporarily connecting said second carrier (12) to said holding device (11) and wherein said coupling means (13) are also releasable for temporarily connecting said second carrier (12) to said warp beam lifting second carriage (14).

5. The apparatus of claim 1, wherein said warp beam lifting second carriage (14) comprises first means (14A, 14B, . . . ) for receiving and holding part of said warp exchange system from said go-between cart (4), second means (14D, 14E, 14F, 14G) for lifting and holding said warp beam (3) from said go-between cart, whereby said first and second means simultaneously receive said warp beam (3) and said part of said warp exchange system, and wherein said first and second means simultaneously transfer said warp beam (3) and said part of said warp exchange system to said loom for inserting said warp exchange system into said loom.

6. A go-between cart for receiving, storing, and transferring a warp exchange system including a warp beam (3) from a drawing-in first carriage (1) to a warp beam lifting second carriage, comprising a cart body (4'), a fixed warp beam support (5) rigidly secured on said cart body (4) for holding a warp beam (3), and a carrier system (10, 10A, 10B; 12, 12A, 12B) on said cart body for supporting said warp exchange system except said warp beam, said cart body and said carrier system on said cart body being dimensioned and positioned on the cart body for moving said go-between cart into said drawing-in first carriage for taking over said warp exchange system and said warp beam (3) from said drawing-in first carriage, said carrier system on said go-between cart including means for cooperating with said warp beam lifting second carriage for said transferring.

7. The go-between cart of claim 6, wherein said carrier system comprise a first carrier section (10) including at least one vertical post (10A) secured to said cart body (4), at least one carrier arm (10B), a journal (10C) journalling said carrier arm (10B)to said vertical post (10A), said carrier arm having a free end opposite said journal (10C), and a holding device (11) secured to said free end of said carrier arm (10B), said carrier system further comprising a second carrier section (12) removably secured to said holding device (11) for carrying said warp exchange system except said warp beam (3), said second carrier section (12) comprising a substantially horizontally extending arm (12A), a substantially vertically extending arm (12B), and a connecting member (12C) securing said substantially vertically extending arm (12B) to said substantially horizontally extending arm (12A), and a coupling (13) at an upper free end of said substantially vertically extending arm (12B) for cooperation with said second carriage (14), said substantially vertically extending arm having a lower end for cooperation with said holding device (11) for removably securing said second carrier section (12) to said first carrier section (10).

8. The go-between cart of claim 7, wherein said connecting member (12C) is an adjustable clamp.

9. The go-between cart of claim 7, wherein said substantially horizontally extending arm (12A) comprises an attachment mechanism (6A) for securing said warp exchange system except said warp beam (3) to said arm (12A).

10. The go-between cart of claim 7, wherein said substantially horizontally extending arm (12A) has a free end with a stop member (12E) for holding a heald frame (7) in place.

* * * * *